United States Patent [19]

Ferdinand

[11] 4,226,155

[45] Oct. 7, 1980

[54] MUSIC SYNTHESIZER

[75] Inventor: Scott A. Ferdinand, Hawthorne, Calif.

[73] Assignee: Mattel, Inc., Hawthorne, Calif.

[21] Appl. No.: 12,885

[22] Filed: Feb. 16, 1979

[51] Int. Cl.[3] ..... G10F 1/00

[52] U.S. Cl. ..... 84/1.03; 84/DIG. 12; 84/DIG. 20

[58] Field of Search ..... 84/1.01, 1.03, DIG. 11, 84/DIG. 12, DIG. 20, DIG. 23

[56] References Cited

U.S. PATENT DOCUMENTS

| | | | |
|---|---|---|---|
| 3,842,702 | 10/1974 | Tsunoo | 84/1.01 |
| 3,918,341 | 11/1975 | Bunger | 84/1.01 |
| 3,955,459 | 5/1976 | Mochida et al. | 84/1.01 |
| 4,022,098 | 5/1977 | Deutsch et al. | 84/1.01 |
| 4,064,777 | 12/1977 | Akamatsu | 84/DIG. 12 |

OTHER PUBLICATIONS

Lancaster, "Keying & ICA Circuits," Popular Electronics, Feb., 1975, p. 38.

*Primary Examiner*—J. V. Truhe
*Assistant Examiner*—Forester W. Isen

[57] ABSTRACT

A music synthesizer is disclosed which includes a keyboard for entering musical notes to be synthesized into the music synthesizer. The music synthesizer also includes a rhythm control arrangement, such as push buttons, for selecting prestored repetitive rhythm pattern tempos to be synthesized into the music synthesizer. A single microprocessor computer is provided which processes and establishes priority of signals from the keyboard and the rhythm control buttons for generating signals indicative of the frequency and amplitude of the musical note to be synthesized and for generating musical instrument signals and combining them into the rhythm pattern to be synthesized. A tone generator is provided which is controlled by the computer for generating a squarewave signal having the frequency of the musical note to be synthesized. A tone blender and shaper is provided which includes a first wave shaping circuit which receives signals from the tone generator and from the computer to form a first signal having a first predetermined wave shape indicative of the musical note to be synthesized. The tone blender and shaper includes a second wave shaping circuit which receives signals from the computer to form a second signal having a second predetermined wave shape which is indicative of a drum beat of predetermined frequency which forms a portion of the rhythm pattern to be synthesized. The tone blender and shaper includes a third wave shaping circuit which receives signals from the computer to form a third signal having a third predetermined wave shape indicative of a snare drum sound which forms a portion of the rhythm pattern to be synthesized. The tone blender and shaper also includes a circuit for combining the first, second and third signals into a composite signal. The composite signal is then amplified and applied to a speaker to form sound waves which comprise the preselected repetitive rhythm pattern and the musical notes determined by operation of the keyboard.

6 Claims, 12 Drawing Figures

MUSIC SYNTHESIZER

BACKGROUND OF THE INVENTION

The background of the invention will be discussed in two parts:

1. Field of the Invention

This invention relates to music synthesizers, and more particularly to a music synthesizer sufficiently small to be held and played by hand and sufficiently inexpensive to be mass produced and made available at a modest cost.

2. Description of the Prior Art

In the past twenty or thirty years, there has been developed a broad line of electronic music instruments which may be generally categorized as music synthesizers. Such devices generate sound entirely by electronic means. The devices create or generate electronic waveforms, which are then shaped and blended together in various manners to create different types of waveforms which can be amplified and played through conventional speakers to create different types of sounds.

One of the more common examples of this type of music synthesizer is the conventional electronic organ. Electronic organs have been developed nad marketed which generate sounds in a variety of electronic manners, such as by using various types of known oscillator circuits to generate waveforms of different frequencies and amplitude, and then passing these waveforms through various types of wave shaping networks to create waveforms corresponding to the desired sounds. Such electronic organs are widely found in private homes and are sometimes used in various types of musical groups and bands. However, they have usually been of such size and bulk that they are, in effect, a piece of furniture which must be located at a fixed location and whose price is relatively high.

Other types of electronic organs have been developed in the prior art which utilize digital computers to generate some of the waveforms which can subsequently be amplified and played through speakers to create various types of conventional or unusual musical effects. Such devices have been substantially smaller than the prior art electronic organs described above, but they still have been sufficiently bulky that they cannot be truly hand held instruments. They require legs or other types of supports. In addition, as is usual in computer type apparatus, the circuits and other peripheral equipment required had been relatively elaborate, requiring developers of such devices to resort to combining digital computer circuits with separate logic and analog circuitry resulting in a substantial manufacturing cost to produce such devices.

In recent years, there has been developed by the semiconductor industry a relatively simple, inexpensive device known as a microprocessor. A microprocessor is a small programmable digital computer which is formed on a single semiconductor chip. Such devices typically include a first section which is a true small digital computer, having the various calculating circuits, registers and other components found in conventional digital computers, and a second section which may be termed a read only memory (ROM). In the manufacture of the microprocessor, the program is, in effect, "written" into the ROM by providing suitable masks to create the necessary microcircuitry therein. The program which controls the digital computer is thus permanently written into the computer. The digital computer is then said to be "dedicated" to the particular task for which the program is written into the ROM.

Such microprocesses are physically small and light weight, thereby facilitating their use in small, hand-held devices. In addition, if the microprocessor is produced in sufficient volume to amortize the cost of the design of the program and the masks of the ROM over a large number of microprocessors, they are relatively inexpensive and can be used in devices having modest selling prices.

It is accordingly an object of the present invention to provide a new and improved music synthesizer;

It is another object of the present invention to provide a new and improved music synthesizer which is sufficiently small and light weight to be held by hand and which is sufficiently inexpensive to be made available on a mass market;

It is yet another object of the present invention to provide a new and improved computer geometry to enable a music synthesizer to be built utilizing a single microprocessor as the digital computer means for performing all the control, sequencing, and waveform generation functions necessary to implement a music synthesizer.

SUMMARY OF THE INVENTION

Briefly stated and in accordance with the presently preferred embodiment of the invention, the foregoing and other objects are accomplished by providing a music synthesizer which includes a keyboard for entering musical notes to be synthesized into the music synthesizer. The music synthesizer also includes a rhythm control arrangement, such as push buttons, for selecting prestored repetitive rhythm patterns and tempos to be synthesized into the music synthesizer. A single microprocessor computer is provided which processes signals from the keyboard and the rhythm control buttons for selecting the priority of a musical note to be synthesized and for generating signals indicative of the frequency and amplitude of the musical note to be synethesized and for generating musical instrument signals indicative of the frequency and amplitude of the musical instrument to by synthesized. The computer also combines the musical instrument signals into a pattern indicative of the rhythm and tempo to be synthesized. A tone generator is provided which is controlled by the computer for generating a squarewave signal having the frequency of the musical note to be synthesized. A tone blender and shaper is provided which includes a first wave shaping means which receives signals from the tone generator and from the computer to form a first signal having a first predetermined wave shape indicative of the musical note to be synthesized. The tone blender and shaper includes a second wave shaping means which receives musical instrument signals from the computer to form a second signal having a second predetermined wave shape which is indicative of a drum beat of predetermined frequency which forms a portion of the rhythm pattern to be synthesized. The tone blender and shaper includes a third wave shaping means which receives musical instrument signals from the computer to form a third signal having a third predetermined wave shape indicative of a snare drum sound which forms a portion of the rhythm pattern to be synthesized. The tone blender and shaper also includes means for combining the first, second and third signals into a composite signal. The composite signal is then amplified and applied to a speaker to form sound waves which comprise the preselected repetitive rhythm pattern and the musical notes determined by operation of the keyboard.

For a complete understanding of the invention, together with an appreciation of its other objects and advantages, please see the following detailed description of the attached drawings, in which:

DESCRIPTION OF THE PREFERRED EMBODIMENT

Figure 1:
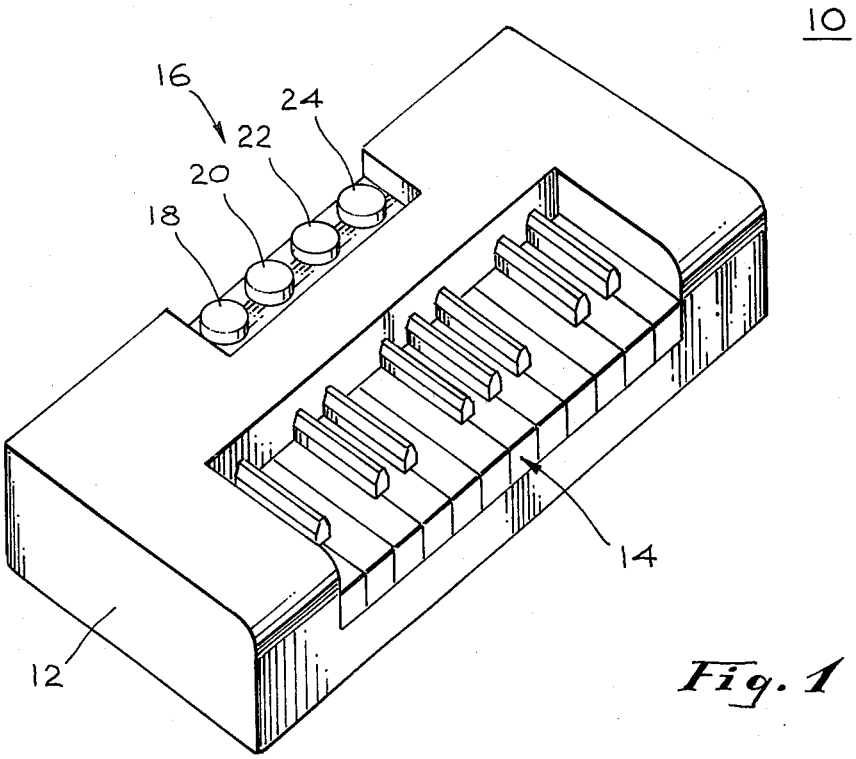
FIG. 1 is a perspective view of a hand-held music synthesizer in accordance with the present invention.

FIG. 1 shows a perspective view of a hand held music synthesizer 10 in accordance with the present invention. As is shown in FIG. 1, the music synthesizer 10 includes a case 12 which includes a keyboard section 14 and a rhythm control section 16. The keyboard section 14 includes a piano type keyboard having a plurality of keys thereon. In the shown embodiment of FIG. 1, there are twenty such keys, the depression of any one of which causes the music synthesizer 10 to generate a corresponding musical tone, although, of course, the invention is not limited to a twenty-key embodiment.

The music synthesizer 10 also includes a rhythm control section 16 which includes push buttons 18, 20, 22 and 24. As is described in more detail below, the push button 18 controls the tempo or rate of repetition of the rhythm pattern generated by the music synthesizer 10, while each of the push buttons 20, 22 and 24 determine a respective rhythm pattern which is generated by the music synthesizer 10. For example, the push button 20 may determine a "pop" rhythm pattern, the push button 22 may determine a "Latin" rhythm pattern, and the push button 24 may determine a "disco" rhythm pattern. The particular rhythm pattern generated by the depression of any one of these push buttons 20, 22 and 24 is described in detail below, although, of course, the music synthesizer 10 may be programmed to generate any other desired rhythm programs.

The hand held music synthesizer 10 also includes a speaker (not shown in FIG. 1), which in the preferred embodiment is located adjacent a grill on the bottom side of the case 12 of the music synthesizer 10. The preferred embodiment of the music synthesizer 10 is easily hand held and played by a child. For example, its length may be about 20 centimeters, its width about 10 centimeters, its height about 4 centimeters and its weight about 200 grams.

Figure 2:
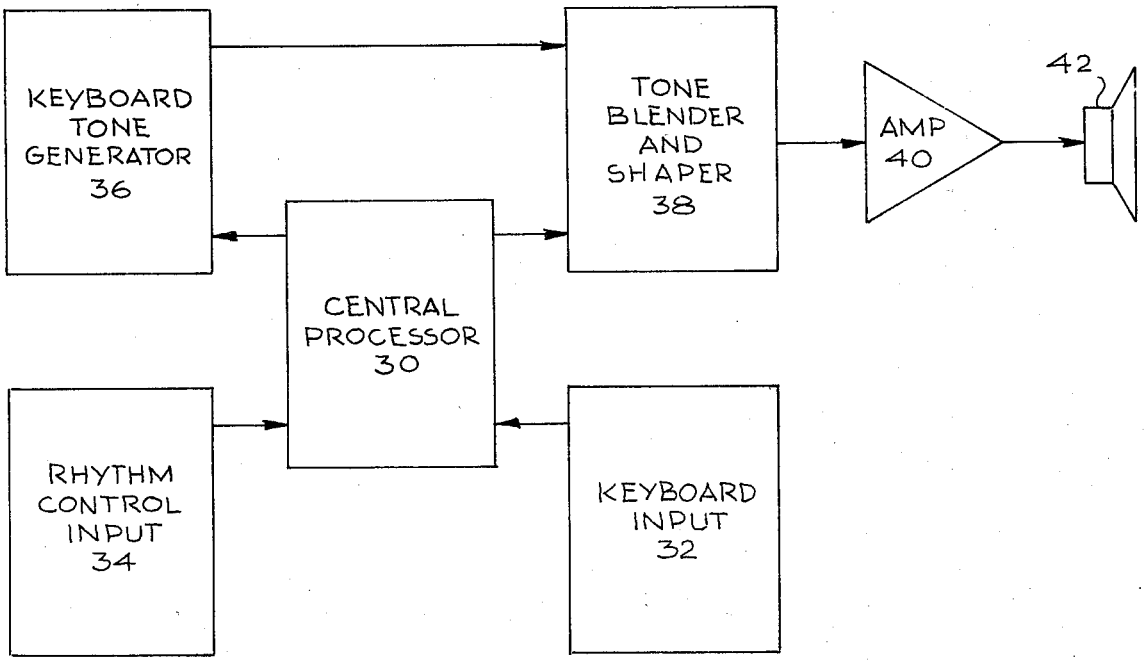
FIG. 2 is a block diagram of the electronic portion of the music synthesizer of FIG. 1.

FIG. 2 shows a block diagram of the electronic portion of the music synthesizer of the present invention. As is shown therein, the music synthesizer includes a central processor 30 whichh receives its input signals from a keyboard input 32 and a rhythm control input 34. The central processor is preferably a microprocessor such as was described above and may be a Rockwell International PPS-4/1 MM76L micromputer. As is described in more detail in connection with the descriptions of FIGS. 3 and 4 below, the keyboard input 32 receives its input control signals from the keyboard 14 of FIG. 1, and the rhythm control input 34 receives its input signals from the rhythm control section 16 of FIG. 1.

Figure 5:
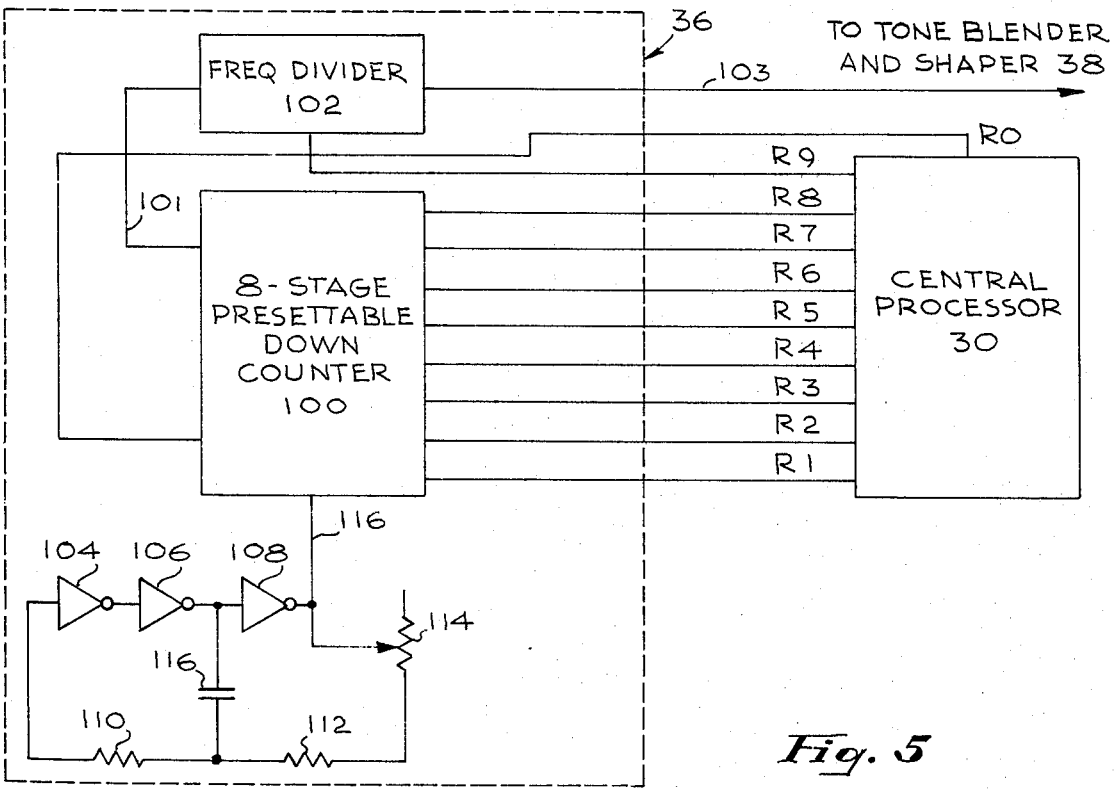
FIG. 5 is a circuit diagram of the keyboard tone generator section of the block diagram of FIG. 2.
Figure 6:
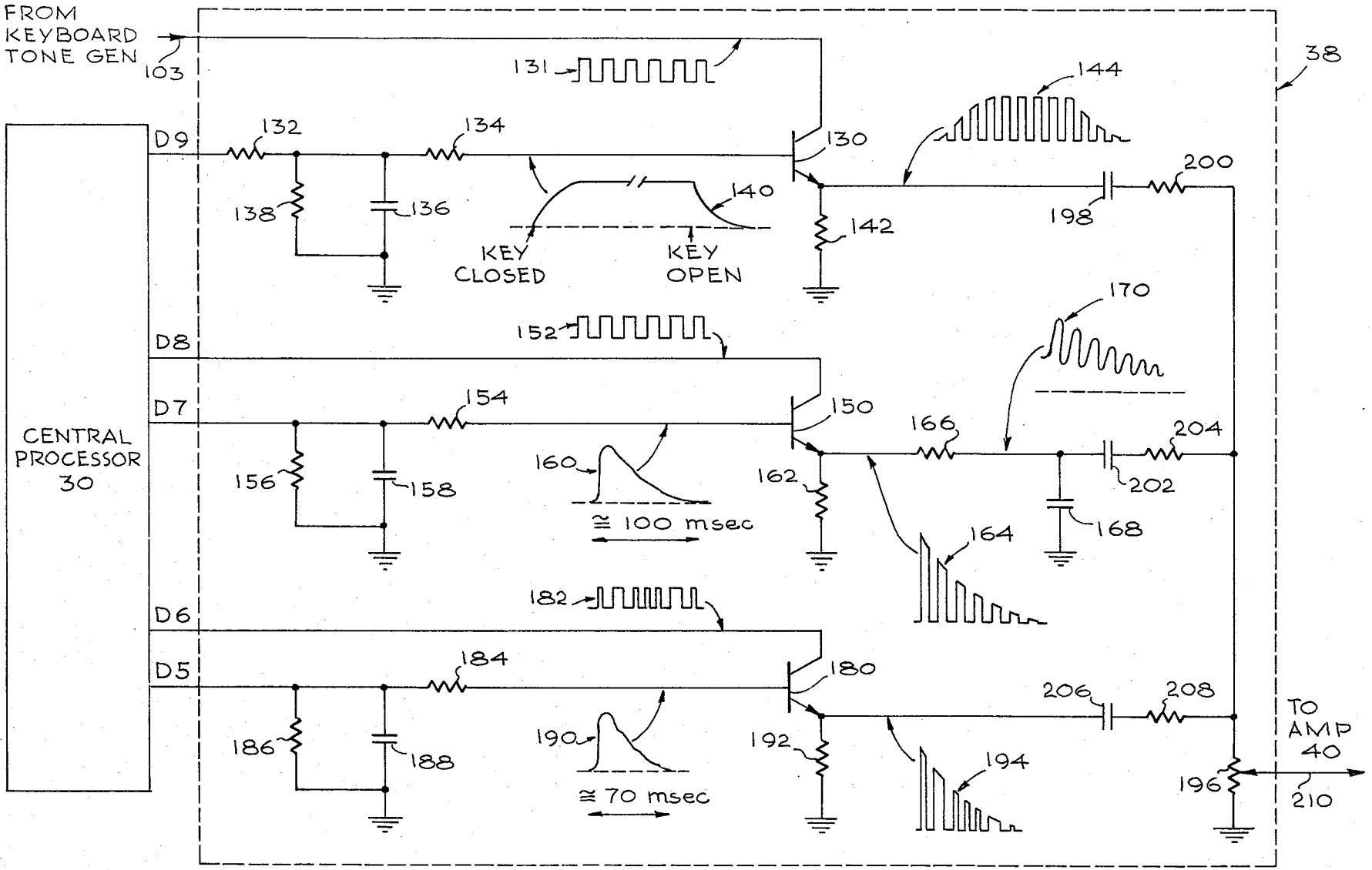
FIG. 6 is a circuit diagram of the tone blender and shaper section of the block diagram of FIG. 2.

In response to inputs from the keyboard input 32 and rhythm control input 34, the central processor provides necessary output signals to the keyboard tone generator 36 and the tone blender and shaper 38, which also receives input signals from the keyboard tone generator 36. The tone blender and shaper 38 combines and shapes the signals from the central processor 30 and the keyboard tone generator 36 to form the musical signals which are to be generated by the music synthesizer. Details of the keyboard tone generator 36 and tone blender and shaper 30 are shown in FIGS. 5 and 6, described below.

The output signal from the tone blender and shaper 38 is applied to an audio amplifier 40 for suitable amplification to a desired audio level. The output signal amplifier 40 is then applied to a speaker 42 which, as was noted above, is located behind a grill in the case 12 of the music synthesizer.

Figure 3:
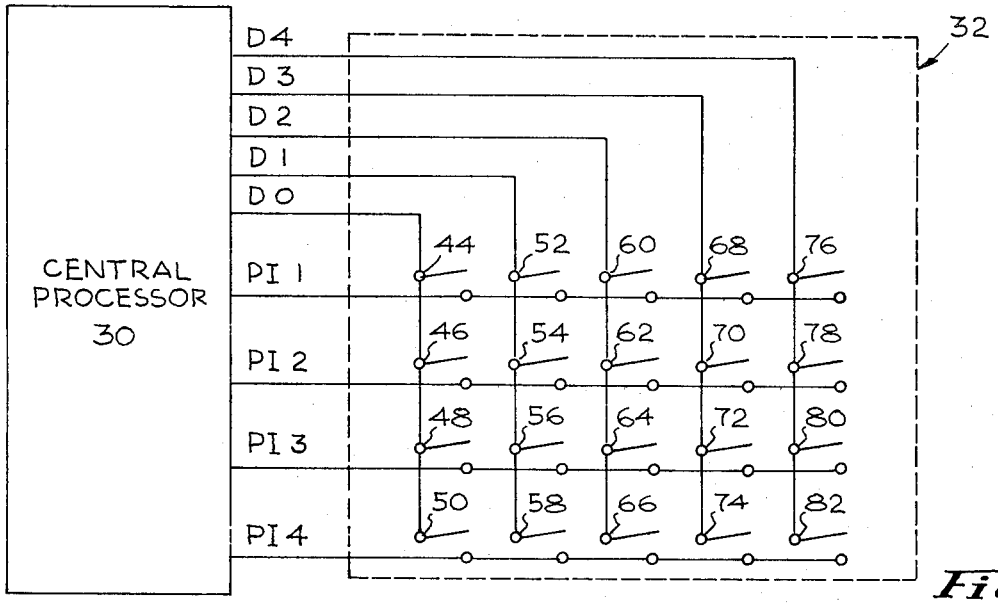
FIG. 3 is a circuit diagram of the keyboard input section of the block diagram of FIG. 2.

FIG. 3 shows a circuit diagram of the keyboard input 32, and illustrates the manner in which it is connected to the central processor 30. As is shown in FIG. 3, the keyboard input 32 includes twenty switches 44 through 82, each of which corresponds to a relative one of the keys on the keyboard 14 of the music synthesizer 10. The switches 44 through 82 are numbered according to ascending tone or frequency of the keys on the keyboard 14, with the lower numbered switch corresponding to the key to generate a lower frequency tone. Thus, the depression of the key which closes the switch 44 generates the lowest tone which can be generated by the keyboard 14, the depression of the key which closes the switch 46 causes the generation of the next lowest tone, and so on up to the depression of the key which closes the switch 82 which causes the generation of the highest tone which can be generated by the keyboard 14.

The switches 44 through 82 are connected as shown in a polled switch matrix. The output lines D0 through D4 from the central processor 30 are connected to the vertical columns of the matrix, while the input or return lines PI1 through PI4 to the central processor 30 are connected to the horizontal ranks of the matrix. As is described in detail below, in operation, output lines D0 through D4 are turned on one at a time, and then the return lines PI1 through PI4 are inspected by the central processor 30. If the appropriate output line is turned on and any switches closed, the appropriate return line for the closed switch will be at a high logic level. Since the central processor 30 knows which output line is on and which input lines is at a high level, it can determine which note is to be played. Knowing this information, the central processor 30 provides appropriate output signals to the keyboard tone generator 36 and tone blender and shaper 38 to cause the generation of the desired keyboard tone.

As is also described in more detail below, a priority is set up on the keyboard 14 such that the lowest key depressed will override any higher key depressed, thereby causing the generation of the tone corresponding to the lowest key depressed. This is done by providing an output signal on an output line D0. The central processor 30 inspects input line PI4 first. If it is closed, the processor 30 stores data concerning a PI4 closure. Next, input line PI3 is inspected. If it is closed, a signal so indicating will replace the data produced by the PI4 input, and so on up to PI1. Thus, the data stored corresponding to the lowest PI input line with a closure will produce the data used to decode which note to play. Next an output signal is provided on output line D1 and then the input lines are again inspected. This continues until a switch closure is seen. After a note is detected, the strobe which controls the generation of output signals on the output lines D0 through D4 returns to D0, so that no keys in columns on output lines greater than the first note detected are ever looked at.

Thus, the depression of one or more of the keys on the keyboard 14 results in the closure of a corresponding one or more of the switches 44 through 82. This causes the central processor 30 to receive a signal which the central processor 30 decodes to determine the lowest numbered switch closed in response to the depression of one of the keys on the keyboard 14. As is described in detail below, in connection with FIGS. 5 and 6, from this information the central processor 30 provides output signals to the keyboard tone generator 36 and tone blender and shaper 38 to cause the generation of an audio tone corresponding to the lowest key depressed on the keyboard 14.

Figure 4:
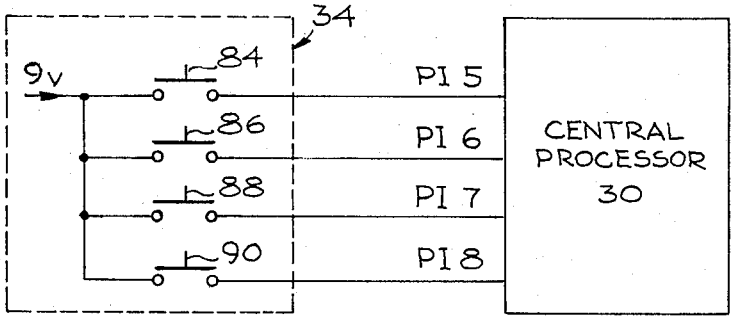
FIG. 4 is a circuit diagram of the rhythm control input section of the block diagram of FIG. 2.

FIG. 4 shows a circuit diagram of the rhythm control input 34, and illustrates how it provides signals to the central processor 30 to control the rhythm pattern generated by the music synthesizer 10. In the preferred embodiment of the invention, the music synthesizer 10 generates any one of three selected rhythm patterns, such as the above referenced "pop" rhythm pattern, "Latin" rhythm pattern, and "disco" rhythm pattern. It is also capable of generating any one of these rhythm patterns at any one of three tempos, or rates of repetition. Each rhythm pattern includes four different sound patterns, these being a low frequency drum sound, mid frequency drum sound, a high frequency drum sound and a snare drum sound, with these four drum sounds being arranged in a sequence or pattern which is selected by the user of the music synthesizer. By using the central processor 30 to decode the keyboard 32 and rhythm 34 control inputs, simple and inexpensive signal pole single circuit switches 44 through 90 can be used for all input functions.

In the preferred embodiment, each of these rhythm patterns is a thirty-two beat pattern, after which the rhythm pattern is repeated again. The following Tables 1 through 3 illustrate three such rhythm patterns which may be generated by the music synthesizer, with Table 1 indicating the "pop" rhythm pattern, Table 2 indicating the "Latin" rhythm pattern, and Table 3 indicating the "disco" rhythm pattern.

TABLE 1

| | BYTE POINTER | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
| SNARE DRUM | x | x | x | | x | | x | | x | | x | | x | | x | | x | | x | | x | | x | | x | | x | | x | | x | |
| HIGH DRUM | | | | | x | | | | | | | | x | | | | | | | | x | | | | | | | | x | x | | |
| MID DRUM | | | x | | | | | | | | x | | | | | | | | x | | | | | | | | | | | | x | |
| LOW DRUM | x | | | | | | x | | x | | | | | | | | x | | | | | | x | | x | | | | | | | x |

TABLE 2

| | BYTE POINTER | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
| SNARE DRUM | x | | x | | | x | | | | | x | | x | | x | | x | | | x | | | x | | | | x | | x | | x | |
| HIGH DRUM | | | | | x | | | | | | x | | | x | x | x | | | | | x | | | | | | x | | | x | x | |
| MID DRUM | | | x | | | | x | | x | x | | x | | | | | | | x | | | | | x | | x | | x | | | | x |
| LOW DRUM | x | | x | | | | | x | | | | | x | | | | x | | | x | | | | | x | | | | x | | | |

TABLE 3

| | BYTE POINTER | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
| SNARE DRUM | x | x | x | | x | | x | | x | | x | | x | | x | | x | | x | | x | | x | | x | | x | | x | | x | |
| HIGH DRUM | | | | | x | | | | | | | | x | | | | | | | | x | | | | | | | | x | | | |
| MID DRUM | | | | | | x | | | | | | | | x | | | | | | | | x | | | | | | | | | x | x |
| LOW DRUM | x | | | | | | x | | x | | x | | | | | | x | | | | | | | x | x | | x | | | | | |

As is shown in FIG. 4, the rhythm control input includes four push button switches 84, 86, 88 and 90, each of which is closed by the depression of a respective one of the push buttons 18, 20, 22, and 24 of the rhythm control section 16. The depression of these push buttons 84 through 90 causes the connection of the 9-volt, or high logic signal, over a respective one of the input lines PI5, PI6, PI7, and PI8 to the central processor 30.

Switch 84, which is closed by the depression of the tempo push button 18, is connected to a tempo speed register in the central processor 30. This tempo speed register is a two-stage register which can store values 0, 1, 2, and 3. If the value of the register is 0, no rhythm is played. If the value of the register is 1, a low tempo rhythm is played. If the value of the register is 2, a mid tempo rhythm is played. If the value of the register is 3, a high tempo rhythm is played. Depression switch 84 increments this register upward one step. If the register is at a value of 3, depression of switch 84 returns the register to zero, turning the rhythm section off.

Switches 86, 88 and 90 correspond to push buttons 20, 22 and 24, respectively. The depression of any one of these buttons, and the resultant closure of its corresponding switch, causes the central processor 30 to load appropriate rhythm data into a rhythm pattern register to cause the generation of one of the rhythm patterns shown in Tables 1, 2, and 3, depending upon which switch is closed. The manner in which the depression of these push buttons and the resultant closure of these switches causes this data to be loaded into the register, and the manner in which the data in this register causes the sounds to be generated is described in detail below in connection with the description of FIGS. 7 through 12.

FIG. 5 shows a circuit diagram, partially in block diagram form, of the keyboard tone generator 36, and illustrates how it generates the keyboard tone corresponding to the depression of a particular key on the keyboard 14. The keyboard tone generator 36 includes an eight-stage presettable down counter 100 whose output is connected over a line 101 to a frequency divider 102. As is described below, the desired keyboard tone generated by keyboard tone generator 36 appears as a squarewave of appropriate frequency on the output line 103 from the frequency divider 102, which is then provided to tone blender and shaper 38.

The keyboard tone generator 36 includes a squarware tunable oscillator which is formed by the inverters 104, 106, 108, the resistors 110, 112, 114 and the capacitor 116. Such a squarewave oscillator is well known to those skilled in the art, and the operation of this circuit is not described herein.

This squarewave oscillator generates a squarewave output signal whose frequency is a function of the setting of the variable resistor 114. In a preferred embodiment, the resistor 114 is variable over a range to provide an output signal from the squarewave oscillator having a frequency range from about 150 kHz to about 400 kHz. This output signal is connected over the line 116 to the input of the eight-stage presettable down counter 100.

The downcounter 100 also receives binary input signals from the central processor 30 over the lines R1 through R8 and an enable input signal over line R0. When the central processor 30 decodes the input signals provided by keyboard input 32 (see FIG. 3), appropriate logic signals are provided over the lines R1 through R8 to the downcounter 100, depending upon the frequency of the keyboard tone to be generated. The downcounter 100 then counts this number of pulses on its input line 116, and when the count is reached, it provides an output pulse on its output line 101 to the frequency divider 102.

In the preferred embodiment, the frequency divider 102 is two flip-flop circuits connected in series. The signal on the line 101 is provided to the input of the first flip-flop, and the first flip-flop drives the second flip-flop, whose output signal appears on line 103. Thus, normally the output signal on line 103 is a squarewave having a frequency equal to one-fourth of the frequency of the pulses appearing on line 101, and frequency divider 102 effectively divides this frequency by a factor of four.

However, frequency divider 102 also receives an input from central processor 30 over line R9. If a signal is present on line R9, it is connected to the first flip-flop in the frequency divider 102, effectively disabling it and allowing the input pulses on line 101 to be passed directly to the second flip-flop. In this event, the output signal on line 103 is a squarewave having a frequency equal to only one-half of the frequency of the pulses on the input line 101. Thus, the signal on line R9 is effectively an octave signal. When the central processor 30 decodes the input signals from keyboard input 32, if it indicates that a high frequency tone is to be generated, such a signal is provided by central processor 30 on line R9 to cause the generation of the squarewave of appropriate frequency on output line 103. In the preferred embodiment, the range of this frequency is from about 150 Hz to about 2000 Hz.

FIG. 6 is a circuit diagram of the tone blender and shaper 38 illustrates how it receives the signals from the keyboard tone generator 36 and the central processor 30 to generate the desired audio composite signal to provide to amplifier 40 and speaker 42. The tone blender and shaper 38 generates three separate signals which are subsequently combined to provide the desired output signal. These signals are the keyboard tone signal, the drum signal (which may be low frequency, mid frequency, or high frequency) and the snare drum signal. Let us consider how each of these are generated separately.

KEYBOARD TONE SIGNAL GENERATION

The desired keyboard tone signal is formed in the keyboard tone transistor 130. The collector of this transistor receives its input from the keyboard tone generator 36 over line 103. As was described in connection with FIG. 5 above, the signal on line 103 is a squarewave having a frequency corresponding to the frequency of the desired tone indicated by the particular key depressed on the keyboard 14. The squarewave is indicated as waveform 131 in FIG. 6.

The base electrode of transistor 130 is connected through a resistor-capacitor network to the output line D9 of central processor 30. D9 is connected to the base electrode through resistors 132 and 134. Connected between the junction of resistance 132 and 134 is the parallel capacitor 136 and resistor 138.

As is described in detail below, whenever a key is depressed on the keyboard 14, a keyboard enable signal appears on output line D9 from central processor 30. Because of the capacitor 136 and resistance 138, this causes a waveform 140 to appear on the base electrode of the transistor 130. When the key is initially closed, the waveform builds exponentially to its final value, which is maintained for as long as the key is kept closed. When the key is opened, the keyboard enable signal is removed from the output line D9, and the signal on the base electrode decays as shown at the trailing edge of waveform 140.

As is shown in FIG. 6, the transistor 130 is connected as an emitter follower, with the resistor 142 being connected between the emitter electrode of transistor 130 and ground. The combination of the signals 131 in the collector electrode and 140 in the base electrode of transistor 130 results in a signal having the waveform 144 being generated across the resistor 142. This is a signal having a frequency corresponding to the frequency of the depressed key on the keyboard 14, and which has leading and trailing edge characteristics which simulate an organ sound. Thus the central processor 30 is used to derive the frequency component 131 of the keyboard tone signal 144 by controlling a single keyboard tone generator 36, as well as to derive the amplitude component 140 via the enable signal appearing on output line D9.

DRUM SIGNAL GENERATION

All three drum sounds, whether of the low frequency drum, the mid frequency drum or the high frequency drum, are formed in the drum transistor 150. As is shown in FIG. 6, the collector electrode of transistor 150 is connected to output line D8 of central processor 30. As is described in more detail below, a squarewave 152 is provided on output line D8. The frequency of squarewave 152 is determined by whether a low frequency drum sound, a mid frequency drum sound or a high frequency drum sound is desired. For example, the squarewave 152 may be provided having a frequency of approximately 80 Hz, 120 Hz, and 240 Hz, depending upon the frequency of the drum sound to be played. The base electrode of transistor 150 is connected to output line D7 of central processor 30 through a resistor 154. Connected between the junction of the resistor 154 and output line D7 is a parallel resistor-capacitor network formed from resistor 156 and capacitor 158, the other terminals of which are connected to ground. As is described below, whenever a drum sound of whatever frequency is desired, a drum enable pulse is provided by the central processor 30 on output line D7. This drum enable pulse, which has a duration of only about one hundred fifty microseconds, is applied to the resistor-capacitor network, which shapes the pulse to form a waveform 160 which is applied to the base electrode of transistor 150. As is shown in FIG. 6, the waveform 160 has a decay time of approximately one hundred milliseconds, and for this time period the transistor 150 is turned on.

Again, transistor 150 is connected as a emitter follower transistor, with a load resistor 162 connected between the emitter electrode of transistor 150 and ground. The combination of the waveform 152 on the collector electrode of transistor 150 and the waveform 160 on the base electrode of the transistor 150 results in a signal having the waveform 164 appearing across the resistor 162. This waveform is further shaped by the network formed of the resistor 166 and capacitor 168, which form a low pass filter which rounds off the edges of the squarewave. This causes the generation of a waveform 170, which gives a more drum-like sound. Thus the central processor 30 is used to derive both the frequency 152 and amplitude 160 components of the drum signal 170 via the musical instrument signals on output lines D8 and D7 respectively.

SNARE DRUM SIGNAL GENERATION

The snare drum sound is generated in snare drum transistor 180. The collector electrode of transistor 180 is connected to output line D6 of central processor 30. As is described in more detail below, whenever a snare drum sound is to be generated, central processor 30 provides on line D6 a squarewave pattern having a pseudorandom frequency, that is a squarewave pattern whose repetition pattern is sufficiently long that it appears in a relatively short segment to be completely random. This simulates the "white" noise sound of a snare drum.

The base electrode of transistor 180 is connected to output line D5 of central processor 30 through a resistor 184. Connected between the junction of the resistor 184 and D5 is a parallel resistor-capacitor network formed from resistor 186 and capacitor 188. Whenever it is desired to play a snare drum sound in the rhythm pattern, a snare drum enable pulse is provided by central processor 30 on output line D5. This enable pulse, which may again have a duration of approximately 2 milliseconds, is shaped by the resistor-capacitor network to form a waveform 190, which is applied to the base electrode of transistor 180. The time constant of the resistor and capacitor in this portion of the circuit are chosen so that the decay time of the waveform 190 is approximately 70 milliseconds.

Again, the transistor 180 is connected in emitter follower fashion, with a load resistor 192 connected between the emitter electrode of transistor 180 and ground. The combination of the pseudorandom squarewave signal 182 on the collector electrode and the decaying enable waveform 190 on the base electrode of transistor 180 causes the generation of the waveform 194 to appear across the load resistor 192. This simulates the white noise sound of a snare drum quite effectively. Thus the central processor 30 is used to derive both the frequency 182 and amplitude 190 components of the snare drum signal 194 via the musical instrument signals on lines D6 and D5 respectively.

The output wave patterns from the tone blender and shaper 38 are the modulated keyboard tone pattern shown by the waveform 144, the drum pattern shown by the waveform 170 and the snare drum pattern shown by the waveform 194. All three of these signals are coupled to a volume control resistor 196. Waveform 144 is coupled to volume control 196 through capacitor 198 and resistor 200. Waveform 170 is coupled to volume control resistor 196 through capacitor 202 and resistor 204. Waveform 194 is connected to volume control resistor 196 through capacitor 206 and resistor 208.

These combined waveforms in volume control resistor 196 form the overall output signal from the tone blender and shaper 38. Such a composite signal appears on output line 210 taken from the variable tap of volume control resistor 196, and is supplied to the amplifier 40 of FIG. 2. This amplifier then provides the desired signal to the speaker 42, which converts the electrical signal into a mechanical sound signal which will be heard by the operator and other persons in the vicinity of the music synthesizer 10.

FIGS. 7 through 12, which interconnect with each other at the places shown in the various figures, represents a flow chart diagram of a program for controlling the central processor 30 to effect the desired music synthesis in the preferred embodiment of the present invention. Throughout these figures, a rectangular box is used to indicate an instruction step in the program, while a diamond shaped box is used to indicate a decision step in the program, as is conventional in the computer programming art.

Figure 7:
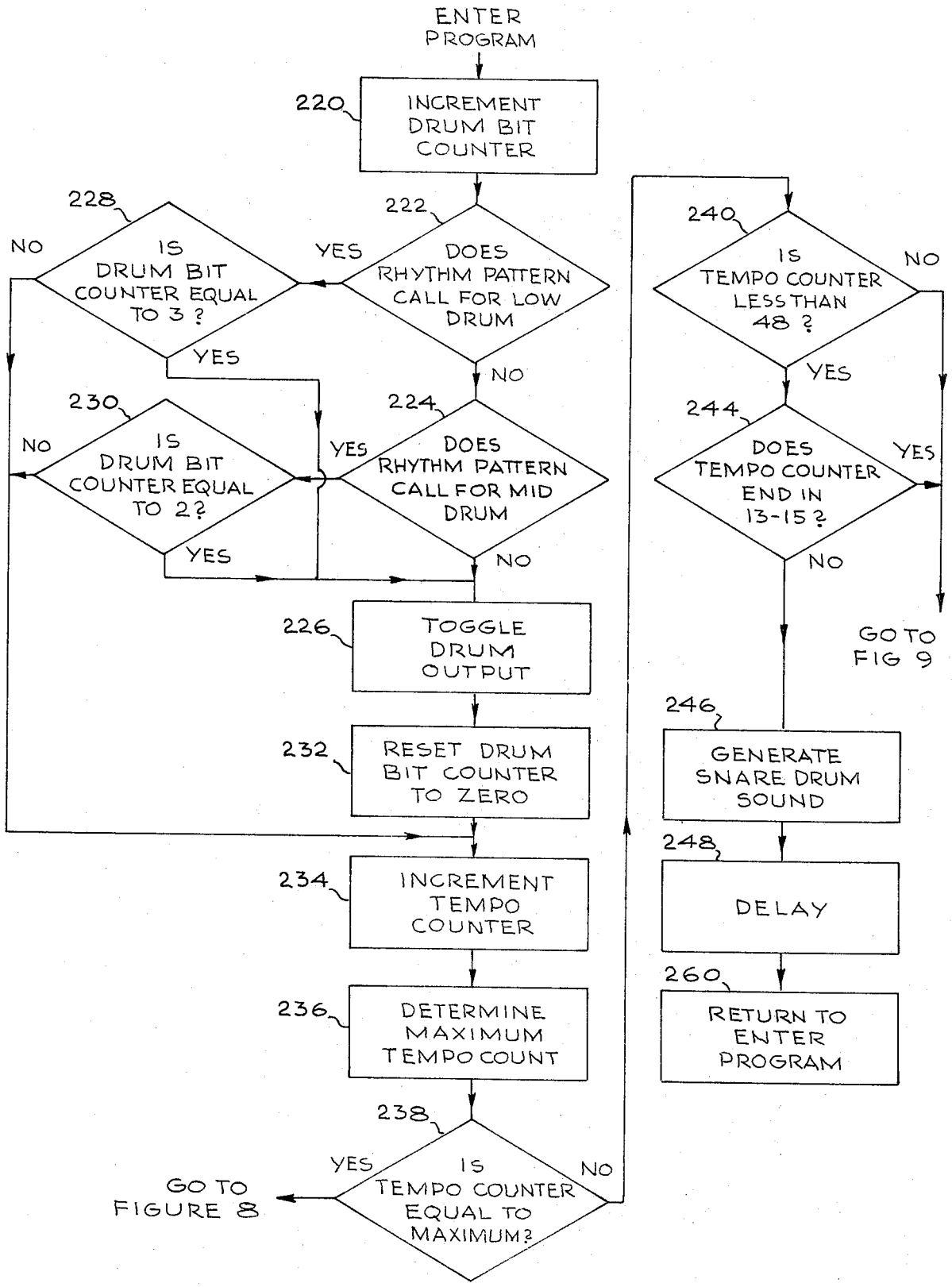
FIGS. 7 through 12 are flow charts showing the program and operation of the preferred embodiment of the music synthesizer of the present invention.

FIG. 7 shows the beginning steps in the program, and illustrates how the waveforms which represent the drum sound and the snare drum sound (waveforms 152 and 182, respectively, of FIG. 6) are generated. The program is entered at instruction step 220, at which step the drum bit counter is incremented. The program then moves to decision step 222, at which point the rhythm pattern (from the appropriate Table 1 through Table 3) is examined to see if the rhythm pattern calls for a low frequency drum beat at this point. If it does, the pattern branches to the left on the "yes" line, which is described below. If the rhythm pattern does not call for a low frequency drum at this point, the pattern branches on the "no" line to decision step 224.

This is similar to decision step 222, but it examines the rhythm pattern to see if a mid frequency drum beat is required at this point. If so, it branches on the yes line to the left, described below, and if not it branches on the no line to instruction step 226, at which point the drum output is toggled to provide a pulse on output line D8 from central processor 30 in FIG. 6.

If the decision at step 222 is "yes," the program branches to decision step 228, which examines the drum bit counter to see if it's value is equal to three. If this comparison is "yes", the program steps to instruction step 226 directly to toggle the drum output. Similarly, if the comparison at decision step 224 is "yes", that is, if the rhythm pattern calls for a mid frequency drum beat at this point, the program steps to the decision step 230, at which the drum bit counter is interrogated to see if its value is equal to two. If it is, the program steps from this decision step to the instruction step 226 to toggle the drum output.

In any event, after the drum output is toggled at step 226, the program steps to instruction step 232 to reset the drum bit counter to zero.

If the rhythm pattern calls for either a low frequency drum beat or a mid frequency drum beat, and if the value of drum bit counter is not equal to three or two, respective, the output steps from decision steps 228 and 230, respectively, bypass instruction step 232, and the drum bit counter is not reset to zero. Thus, the combination of the instruction steps 220 to 232 result in the waveform 152 appearing on output line D8 from the central processor 30 in FIG. 6, with the frequency of the waveform 152 being low frequency, mid frequency or high frequency, depending upon the frequency of the drum beat desired at this step in the rhythm pattern.

The program next moves to the instruction step 234, at which point the tempo counter is incremented. The next instruction step 236 determines the maximum tempo count for the selected rhythm pattern (which is, of course, a function of the depression of the tempo push button 18 of the rhythm control section 16 of music synthesizer).

At decision step 238, if the tempo counter is equal to the maximum count for the selected rhythm pattern, the program branches on the "yes" line to FIG. 8, described below, for the generation of appropriate drum and snare drum enable signals. If the tempo counter is not equal to the predetermined maximum, the program moves to decision step 240, which inquires if the tempo counter is less than 48. If it is, it moves to decision 244, which interrogates only the last four stages of the tempo counter to see if these stages end in the numbers 13 through 15, (which in binary arithmatic would be 13 through 15, 29 through 31, 45 through 47, etc.). If not, the program moves to instruction step 246, which generates the snare drum sound signal, which is the pseudorandom squarewave pattern 182 on output line D6 of central processor 30 in FIG. 6. Thereafter, the program goes to instruction step 248, which is a delay step to allow sufficient time to pass for a complete cycle of the program, and the program then goes to instruction step 260, which is a return to Enter Program at the beginning of FIG. 7 described above.

If at decision step 240, the tempo counter had been greater than 48, or if at decision step 244 the tempo counter had ended in 13 through 15, the program moves to FIG. 9, described below, in which the rhythm control push buttons 18 through 24 are interrogated to load the appropriate rhythm pattern into the rhythm pattern register of central processor 30.

Figure 8:
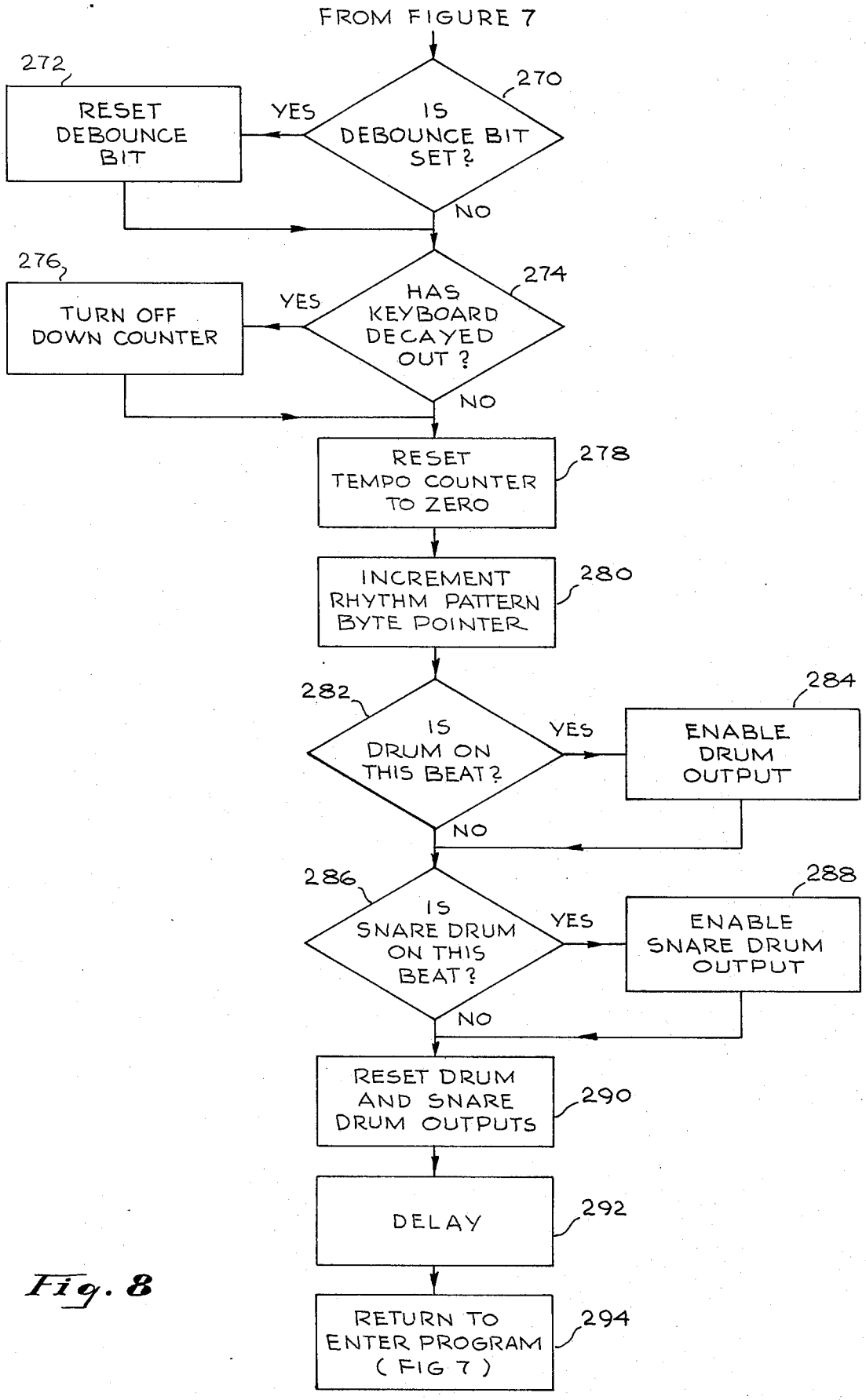

Now describing FIG. 8, if the tempo counter is equal to its predetermined maximum, the program steps to decision step 270, which interrogates the debounce bit to see if it is set. If it is, the program branches to instruction step 272 to reset the debounce bit, and if not, the program moves directly to decision step 274. The problems of contact bounce, and the manner of controlling it by using a debounce bit are well known to those skilled in the computer art, and this portion of the program is not described further here.

At decision step 274, the program interrogates to see if the keyboard tone wave pattern 144 of FIG. 6 has died down. If it has, the program steps to instruction step 276 to turn off the down counter 100 of FIG. 5 by removing its enable pulse from the output line R0 from central processor 30 in FIG. 5.

The program then steps to instruction step 278, at which the tempo counter is reset to zero and then to instruction step 280 at which the rhythm pattern byte pointer is incremented.

The next step in the program is decision step 282, at which the program interrogates the rhythm pattern register to see if a drum beat of any frequency is required at this point. If so, the program steps to instruction step 284 to provide a drum output enable pulse on output line D7 of central processor 30 of FIG. 6. The program then steps to decision step 286, which interrogates the rhythm pattern register to see if a snare drum beat is required at this time. If so, the program steps to instruction step 288 to provide a snare drum output enable pulse on output line D5 of central processor 30 of FIG. 6.

The program then steps to instruction step 290, at which point the drum and snare drum outputs are both reset, from whence the program goes to instruction step 292 to provide sufficient delay time to complete a program cycle and then to instruction step 294, which is a return to Enter Program in FIG. 7.

Thus, the portion of the program described in FIGS. 7 and 8 combined results in the generation of desired drum wave pattern 170 and snare drum wave pattern 194 of FIG. 6.

Figure 9:
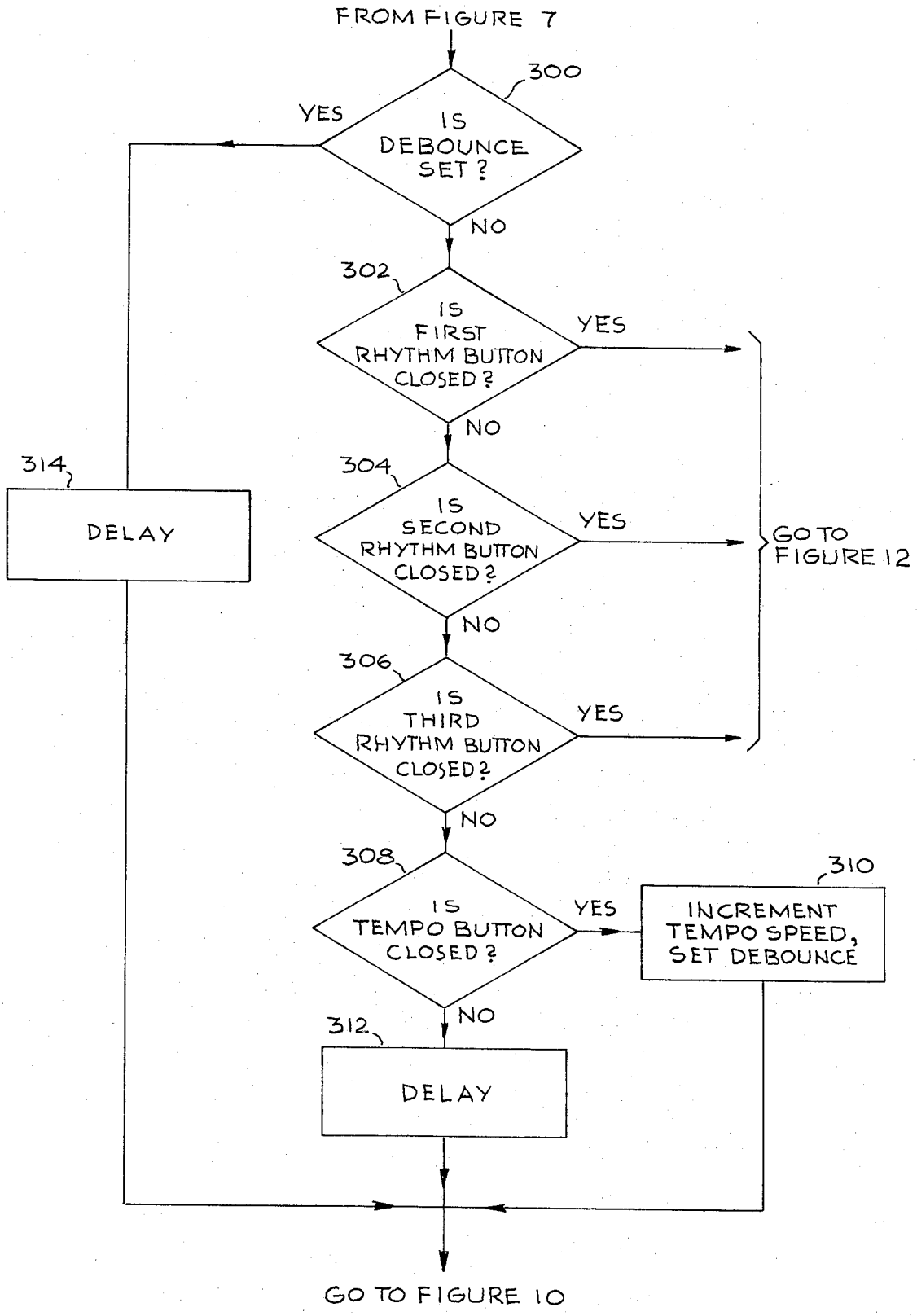

FIG. 9 illustrates the portion of the program which interrogates the rhythm control section of the music synthesizer. The program first passes through decision step 300 to check the debounce bit, and if it is not set, then interrogates to see if any one of the rhythm control buttons 20, 22, and 24 is closed. This is done at decision steps 302, 304 and 306, respectively. If any one of these buttons is closed, the program moves to FIG. 12, described below, in which the appropriate rhythm pattern corresponding to the depressed button is loaded into the rhythm pattern register. If none of these buttons is closed, the program moves to decision step 308 to interrogate if the tempo control button 18 is closed. If so, the program steps to instruction step 310, at which point the tempo speed register is incremented and the debounce bit set. If the tempo button 18 is not closed, the program moves to a delay step 312, after which the program moves to FIG. 10. If the decision step 300 at the beginning of FIG. 7 indicated that the debounce bit was set, so that the rhythm control buttons were not yet ready for interrogation, the program moves to a delay step 314 to bypass all of the interrogation of the rhythm buttons, after which the program moves onward to FIG. 10.

Figure 10:
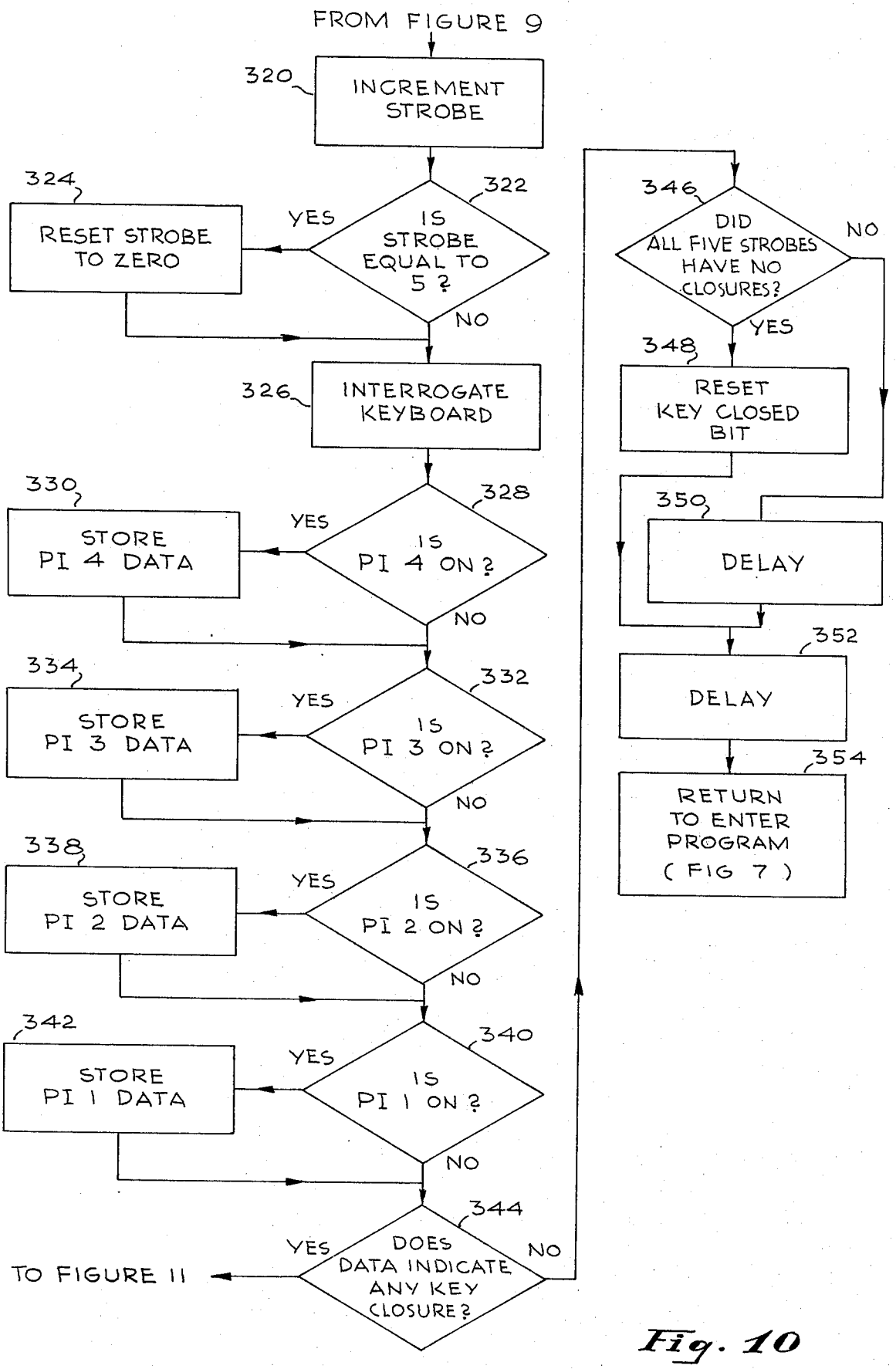

FIG. 10 illustrates those portions of the program in which information is transferred from the keyboard input 32 to the central processor 30 in response to a key closure on the keyboard 14.

The program moves to instruction step 320, which implements a strobe counter in central processor 30. This strobe counter successively provides interrogation pulses onto the output lines D0 through D4 of FIG. 3 of central processor. A strobe count of 0 through 4 provides interrogation pulses onto output lines D0 through D4 respectively.

After the strobe is incremented at instruction step 320, the program moves to decision step 322, which examines the strobe count to see if it is now equal to 5. If so, the program moves to instruction step 324 to reset the strobe count to zero. The program then moves to instruction step 326, at which point the keyboard is interrogated by providing an output pulse on the appropriate output line D0 through D4.

At decision step 328, the central processor 30 examines the input line PI4 of FIG. 3. If the bottom one of the switches on the D line being interrogated is closed, a pulse appears on line PI4, and this information is stored at instruction step 330. Whether or not information was stored at instruction step 330, the program then steps to decision step 332, which examines the presence or absence of a signal on input line PI3. If there is a signal at this point, this information is stored in instruction step 334, replacing the information, if any, obtained from line PI4 previously.

Next, at decision step 336 and instruction step 338, the presence or absence of information on input line PI2 is examined, and if there is any information there, this information replaces the information stored above. Finally, at decision step 340 and instruction step 342, input line PI1 is examined, and if any signal is present there, it replaces the information stored above. In this manner, the information stored corresponds to the lowest frequency key closed on the D line being interrogated.

The program then steps to decision step 344, which examines the stored data to see if it indicated that any key at all was closed in this column. If the data does so indicate, the program moves to FIG. 11, described below, to generate the desired keyboard tone (waveform 144 of FIG. 6).

If the decision step 344 indicated that no key of that column was closed, the program steps to decision step 346, which examines to see if all five strobe pulses have indicated no key closures. If the information has so indicated that no keys are closed, indicating that no keyboard tone is desired at this time, the program steps to instruction step 348, which resets the key closed bit to remove the keyboard enable signal from output line D9 of central processor 30 in FIG. 6. The program then steps to a delay 352 to allow the completion of a complete program cycle and then steps to instruction step 354 to return to the Enter Program step of FIG. 7.

If decision step 346 indicated that all five strobes did not have "no closures", that is, one of the strobes had a closure, the program bypasses instruction step 348, thereby not resetting the key closed bit, passes through the appropriate delay instruction step 350 to delay instruction step 352 and thence to instruction 354 and return to Enter Program.

Figure 11:
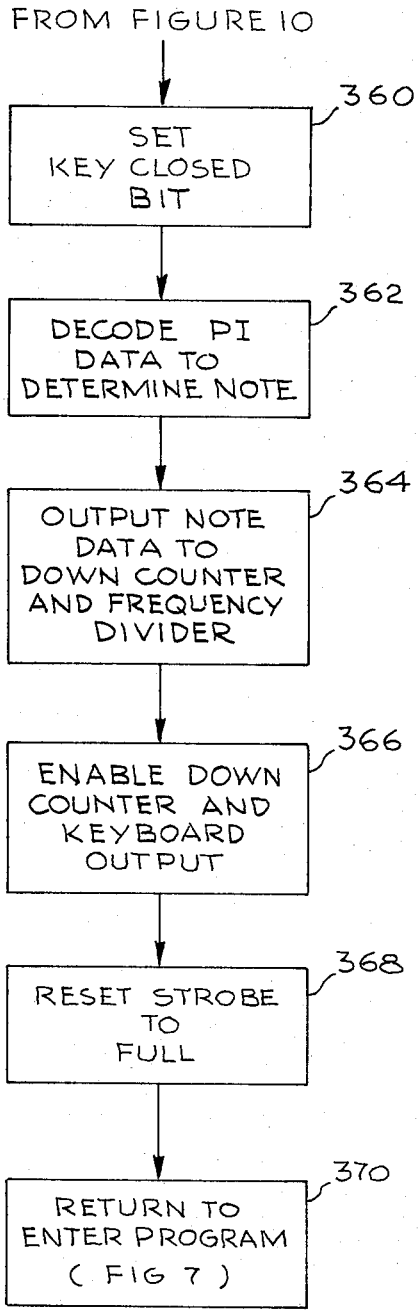

FIG. 11 illustrates that portion of the program which provides the necessary signals to generate the keyboard tone waveform 144 of FIG. 6.

If the decision step 344 of FIG. 10 indicated any key on the keyboard was closed, the program steps to instruction step 360 which sets the keyboard closed bit in central processor 30 and then moves to instruction step 362, which decodes the information stored on the PI input lines to determine which was the lowest key on the keyboard which was depressed. The program then steps to instruction step 364 which provides the appropriate signals on the output lines R1 through R9 of central processor 30, shown in FIG. 5, to set the down counter 100 and frequency divider 102 to provide a squarewave of appropriate frequency on output line 103 to tone blender and shaper 38. The program then steps to instruction step 366, which enables the down counter 100 by providing an appropriate enable signal on output line R0 from central processor 30 in FIG. 5 and also provides an appropriate keyboard output enable signal on output line D9 from central processor 30 in FIG. 6. This causes the generation of the squarewave pattern 131 of appropriate frequency and the keyboard enable wave pattern 140, both in FIG. 6, which, when applied to keyboard output transistor 130, results in the desired keyboard output wave pattern 144 of FIG. 6.

The program then steps to instruction step 368 to reset the strobe counter to "full", so that the next increment of the strobe counter (instruction step 320 of FIG. 10) will step the strobe counter to zero so that, on the next cycle, output line D0 of central processor 30 will be interrogated. The program then steps to instruction step 370, which is returned to Enter Program at FIG. 7.

Figure 12:
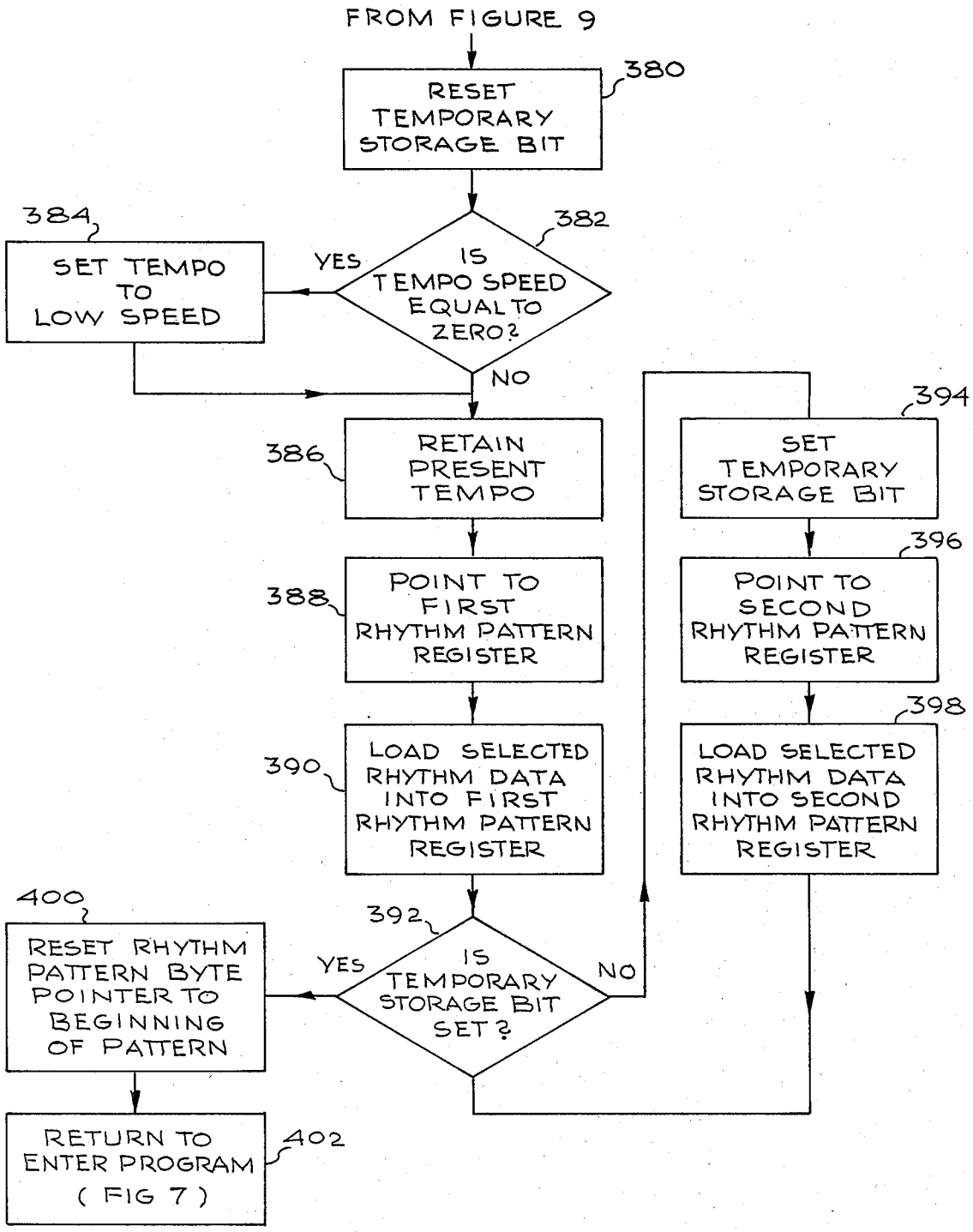

FIG. 12 illustrates that portion of the program in which the appropriate selected rhythm data (as set forth in Tables 1, 2, and 3, above) is loaded into the rhythm pattern register of the central processor. If the interrogation of any one of the rhythm control buttons 20, 22, or 24 indicated a closure of one of these buttons (see the description of the program of FIG. 9 above), the program steps to instruction step 380, which resets a temporary storage bit in the central processor 30. The program then steps to decision step 382, which interrogates the tempo speed register to see if its value is equal to zero. If it is, the program steps to instruction step 384 to set the tempo speed register to low speed. If the tempo speed were not equal to zero, the program steps to instruction step 386, which retains the present tempo.

The appropriate rhythm pattern data is then loaded into the rhythm pattern register in two steps. Two steps are used because, as is shown in Table 1 through 3 above, the rhythm patterns are all thirty-two beat patterns, while the particular microprocessor chip used for the central processor 30 contains sixteen word registers. At instruction step 388, the program points to the first rhythm pattern register, and at instruction step 390, one half of the selected rhythm pattern is loaded into the first rhythm pattern register. The program then steps to decision step 392, which indicates that the temporary storage bit is not set (see instruction step 380 above), and the pattern then steps to instruction step 394, which sets the temporary storage bit. At instruction step 396, the program points to the second rhythm pattern register, and at instruction step 398, the other half of the selected rhythm data is loaded into the second rhythm pattern register.

The program now steps back to decision steps 392, which now indicates that the temporary storage bit is set (see instruction step 394 above), and the program steps to instruction step 400, which resets the rhythm pattern byte pointer to the beginning of the rhythm pattern, or the first beat on Tables 1 through 3.

The program now steps to instruction step 402, to return to Enter Program of FIG. 7, and the program is now completely executed.

While the invention is thus disclosed, and the presently preferred embodiment described in detail, it is not intended that the invention be limited to the shown embodiment. Instead, many modifications will occur to those skilled in the art which lie within the spirit and scope of the invention. It is accordingly intended that the invention be limited only by the appended claims.

What is claimed is:

1. A music synthesizer comprising, in combination:

keyboard means for entering musical notes to be synthesized into the music synthesizer, rhythm control means for selecting prestored repetitive rhythm patterns and tempos to be synthesized into the music synthesizer;

single computer means comprising read only memory means and programmable processor means responsive to the keyboard means and the rhythm control means for selecting the priority of a musical note to be synthesized and for generating a binary signal and a first enable signal indicative of the frequency and amplitude respectively of the musical note to be synthesized and for generating musical instrument signals indicative of the frequency, amplitude, and tone color of the musical instruments to be synthesized, and for combining the musical instrument signals into the rhythm patterns and tempos to be synthesized;

monophonic tone generator means responsive to the binary signal for generating a first squarewave signal having the frequency of the musical note to be synthesized;

tone blender and shaper means including first wave shaping means responsive to the first squarewave signal and the first enable signal for forming a first tone signal having a first predetermined wave shape indicative of the musical note to be synthesized, a second wave shaping means responsive to the musical instrument signals for forming a second tone signal having a second predetermined wave shape indicative of a drum beat of predetermined frequency and forming a portion of the rhythm pattern to be synthesized, a third wave shaping means responsive to the musical instrument signals for forming a third tone signal having a third predetermined wave shape indicative of a snare drum sound and forming a portion of the rhythm pattern to be synthesized, and means for combining the first, second and third signals into a composite signal; and speaker means responsive to the composite signal for forming sound waves comprising the preselected repetitive rhythm pattern and musical notes determined by operation of the keyboard means.

2. The music synthesizer of claim 1 in which the monophonic tone generator means comprises a presettable counter which receives the binary signal from the computer means and an oscillator which applies pulses to the counter, whereby the output signal from the counter is a signal whose frequency is equal to the frequency of the oscillator divided by the binary signal from the computer means.

3. The music synthesizer of claim 1 in which the computer means further includes priority means for responding to only the musical note having the lowest frequency of all musical notes simultaneously entered by the keyboard means into the computer means.

4. The music synthesizer of claim 1 in which the first wave shaping means of the tone blender and shaper means comprises a first transistor, means for applying the first squarewave signal from the tone generator means to a first electrode of the first transistor, means for applying the first enable signal of predetermined wave shape to a second electrode of the first transistor, and means for deriving the first tone signal having the first predetermined wave shape from a third electrode of the first transistor, whereby the frequency and amplitude of the first tone signal are derived from the first squarewave signal and the first enable signal respectively.

5. The music synthesizer of claim 1 in which the second wave shaping means of the tone blender and shaper means comprises a second transistor, means for applying a second squarewave signal of predetermined frequency from the musical instrument signals generated by the computer means to a first electrode of the second transistor, means for applying a second enable signal of predetermined wave shape from the musical instrument signals generated by the computer means to a second electrode of the second transistor, a low pass filter network connected to a third electrode of the second transistor, and means for deriving the second tone signal from the second predetermined wave shape from the low pass filter, whereby the frequency and amplitude of the second tone signal are derived from the second squarewave signal and the second enable signal respectively.

6. The music synthesizer of claim 1 in which the third wave shaping means of the tone blender and shaper means comprises a third transistor, means for applying a third squarewave signal of pseudorandom frequency from the musical instrument signals generated by the computer means to a first electrode of the third transistor, means for applying a third enable signal of predetermined wave shape from the musical instrument signals generated by the computer means to a second electrode of the third transistor and means for deriving the third tone signal having the third predetermined wave shape from a third electrode of the third transistor, whereby the frequency and amplitude of the third tone signal are derived from the third squarewave signal and third enable signal respectively.

* * * * *